United States Patent [19]

Ichimura

[11] Patent Number: 4,577,570

[45] Date of Patent: Mar. 25, 1986

[54] AUTOMATIC APPARATUS FOR PICK-UP SEWING OF CURVED EDGES OF A FABRIC PIECE ON CLOTHING

[75] Inventor: Masatoshi Ichimura, Higashi-Osaka, Japan

[73] Assignee: Eagle Industry Company Limited, Osaka, Japan

[21] Appl. No.: 647,619

[22] Filed: Sep. 5, 1984

[30] Foreign Application Priority Data

Aug. 27, 1983 [JP] Japan ..... 58-179874

[51] Int. Cl.[4] ..... D05B 3/02; D05B 21/00

[52] U.S. Cl. ..... 112/121.12; 112/121.14; 112/309

[58] Field of Search ..... 112/121.14, 121.11, 112/121.12, 121.15, 308, 309, 104, 113

[56] References Cited

U.S. PATENT DOCUMENTS

| | | | |
|---|---|---|---|
| 3,450,076 | 6/1969 | Bender | 112/121.14 X |
| 3,871,306 | 3/1975 | Egtvedt et al. | 112/121.11 |
| 4,309,950 | 1/1982 | Franklin | 112/121.12 X |
| 4,312,282 | 1/1982 | Dorosz et al. | 112/121.12 |
| 4,336,761 | 6/1982 | Magnan | 112/121.12 |
| 4,373,458 | 2/1983 | Dorosz et al. | 112/121.12 |
| 4,419,945 | 12/1983 | Nishina | 112/309 X |
| 4,497,266 | 2/1985 | Fujita et al. | 112/121.11 |
| 4,512,269 | 4/1985 | Bowditch | 112/121.15 X |

*Primary Examiner*—H. Hampton Hunter

*Attorney, Agent, or Firm*—Sachs & Sachs

[57] ABSTRACT

In an automatic pick-up sewing system for curved edges of a fabric piece such as an outer pocket on clothing such as a jacket, the clothing kept in a horizontal state with the fabric piece pressed against a sewing needle is displaced two dimensionally during pick-up sewing as programmed under computer control while the sewing needle is driven for concurrent horizontal rotation so that the point of the sewing needle should always be directed in tangential directions of a sewing line on the fabric piece. Beautiful pick-up sewing is achieved quite at high efficiency without any need for highly skilled manual operation.

7 Claims, 4 Drawing Figures

AUTOMATIC APPARATUS FOR PICK-UP SEWING OF CURVED EDGES OF A FABRIC PIECE ON CLOTHING

BACKGROUND OF THE INVENTION

The present invention relates to automatic method and apparatus for pick-up sewing of curved edges of a fabric piece on clothing, and more particularly relates to computerized automation of a process for pick-up sewing of curved edges of a fabric piece such as an outer pocket to clothing such as a jacket.

Automation has increasingly been introduced into the field of sewing of clothing but pick-up sewing of outer pockets on jackets or the like is still performed by manual operation without allowing introduction of automation. This is due to the fact sewing of curved edges of fabric pieces such as outer pockets on jackets or the like necessitates very complicated movement of a sewing needle. Thus handling of the sewing needle requires highly skilled technique and causes significantly low process efficiency.

SUMMARY OF THE INVENTION

It is the object of the present invention to fully automatize under computer control pick-up sewing of curved edges of a fabric piece on clothing.

In accordance with the basic aspect of the present invention, clothing kept in a horizontal state and pressed against a sewing needle is displaced two dimensionally as programmed by combined operations of X- and Y- directional shifter units having respective servo motors on receipt of operation signals issued by a center control circuit under computer control while the sewing needle on a sewing unit is driven for concurrent horizontal rotation by operation of a servo motor also connected to the above-described center control circuit, whereby the point of the sewing needle should always be directed in tangential directions of a sewing line on the fabric piece.

DESCRIPTION OF PREFERRED EMBODIMENTS

Figure 1:
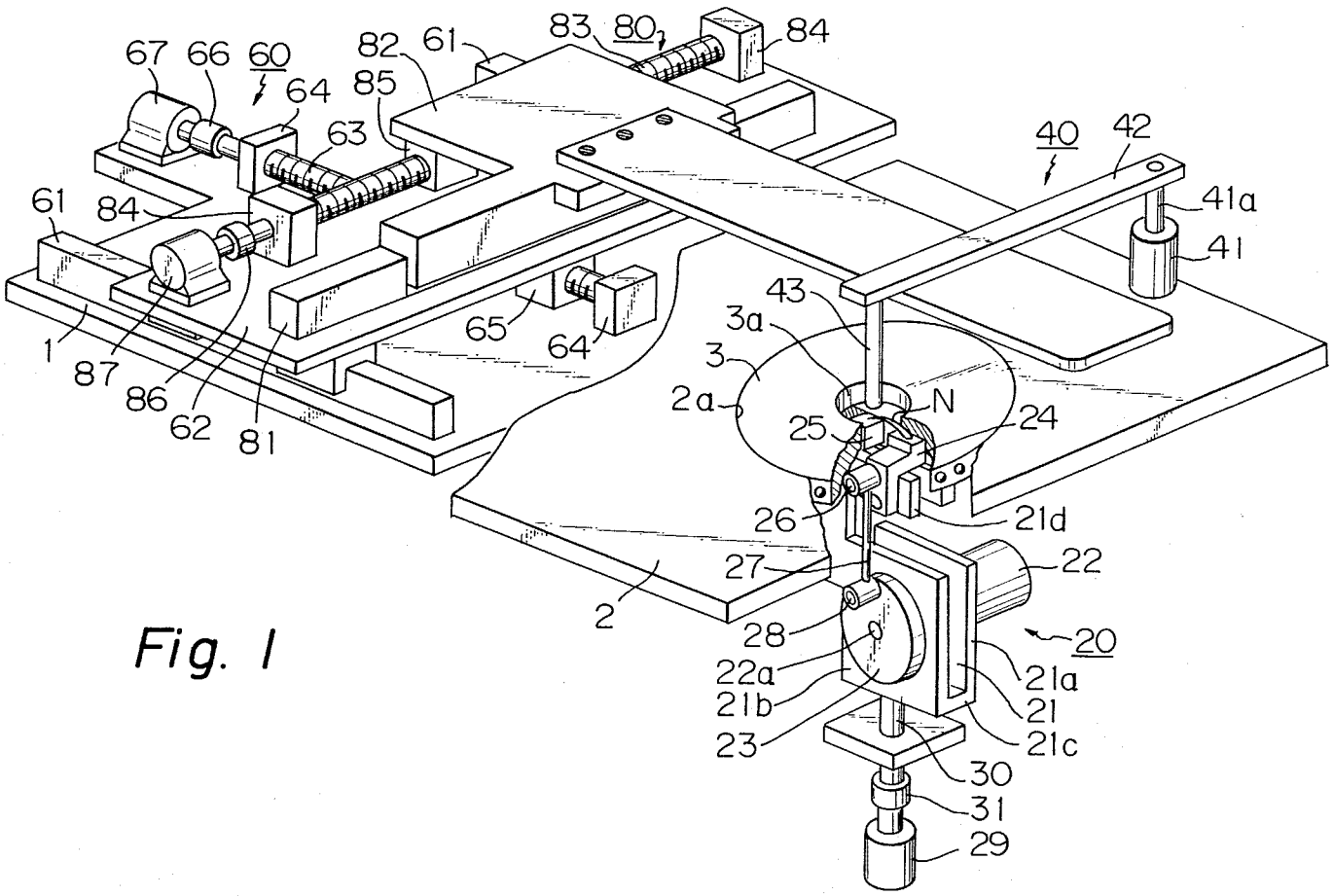
FIG. 1 is a perspective view of one embodiment of the automatic apparatus in accordance with the present invention.

One embodiment of the automatic apparatus in accordance with the present invention is shown in FIG. 1, in which the apparatus includes a flat and horizontal base plate 1 and a flat and horizontal operation table 2 which can be properly secured to the base plate 1. The operation table 2 is adapted for placing clothing to be sewn thereon and provided with a circular opening 2*a*. A circular rotary disc 3 is concentrically received in the circular opening in an arrangement flush with the top face of the operation table 2. The rotary disc 3 is provided with a center opening 3*a*.

The apparatus further includes, as major elements, a sewing unit 20 for pick-up sewing, a pressor unit 40 for pressing the fabric piece of the clothing to be sewn, a clothing controller 90 for moving the clothing two dimensionally on the operation table 2 as programmed, a X-directional shifter unit 60 for shifting the pressor unit 40 in the X direction and a Y-directional shifter unit 80 for shifting the pressor unit 40 in the Y direction.

Sewing unit of any conventional types are usable for the present invention. In the case of the illustrated embodiment, the sewing unit 20 includes a holder bracket 21 which is made up of a pair of spaced, parallel and vertical walls 21*a*, 21*b* and a bottom section 21*c* connecting the vertical walls 21*a* and 21*b*. One vertical wall 21*a* securedly carries a needle drive motor 22 whose output shaft 22*a* extends rotatably through the vertical walls 21*a* and 21*b* and, outside the holder bracket 21, securedly carries a cam disc 23. Another vertical section 21*b* has an upper extension 21*d* located somewhat below the rotary disc 3 and a needle holder 24 is pivoted at its lower end to the upper extension 21*d* of the holder bracket 21. The needle holder 24 carries a sewing needle N facing the center opening 3*a* of the rotary disc 3. The upper extension 21*d* of the holder bracket 21 further carries a bobbin case 25 which contains a thread to be used for sewing. The bobbin case 25 is located just below the center opening 3*a* of the rotary disc 3 at a position to be operated by the needle N. The holder bracket 21 is secured, via a part of the upper extension 21*d*, to the bottom face of the rotary disc 3. A pin 26 secured to the needle holder 24 above its lower pivot is linked, via a connecting rod 27, to a pin 28 secured near the periphery of the cam disc 23. A servo motor 29 is located below the holder bracket 21 and its output shaft is coupled to a rotary shaft 30 via a connector 31. The top end of the rotary shaft 30 is secured to the bottom face of the holder bracket 21. The servo motor 29 is connected to a center control circuit which issues operation signals under computer control.

As the needle drive motor 22 operates, the cam disc 23 rotates and the needle holder 24 swings about its lower pivot so that the need N should deliver a thread from the bobbin disc 25 for pick-up sewing. As the servo motor 29 is driven for operation on receipt of an operation signal from the center control circuit, the holder bracket 21 with the needle N and the rotary disc 3 rotates in the horizontal direction about the center of the rotary disc 3.

The pressor unit 40 includes a solenoid 41 secured vertically on the operation table 2 and the plunger 41*a* of the solenoid holds a horizontal arm 42. The horizontal holder arm 42 carries at its free end a pressor bar 43 which extends downwards and directed to the center of the rotary disc 3.

Figure 2:
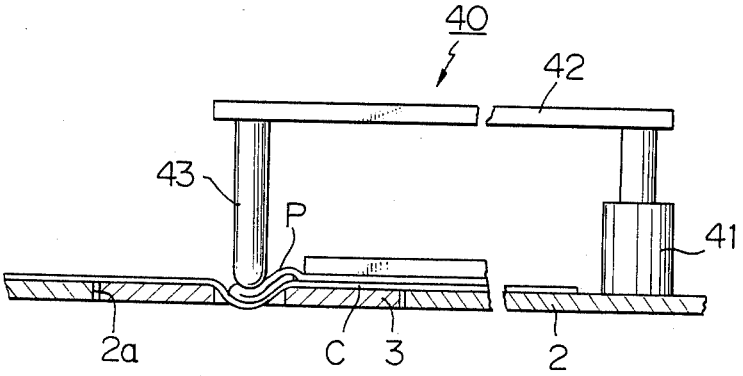
FIG. 2 is a side view partly in section, of the pressor unit used for the automatic apparatus shown in FIG. 1.

On operation of the solenoid 41, the pressor rod 43 moves downwards in order to press the section of the clothing to be sewn into the center opening 3*a* of the rotary disc 3 as shown in FIG. 2.

The X-directional shifter unit 60 includes a pair of spaced parallel guide rails 61 secured on the base plate 1 and a horizontal mobile block 62 slidably mounted to the guide rails 61. The guide rails 61 extend in the X direction. A threaded drive shaft 63 extends on the base plate 1 in parallel to the guide rails 61 while being rotatably carried by bearings 64. The drive shaft 63 is in screw engagement with a thread piece 65 secured to the bottom face of the mobile block 62. One end of the drive shaft 63 is coupled via a connector 66 to a servo motor 67 arranged on the base plate 1. This servo motor 67 is also connected to the above-described center control circuit. As the servo motor 67 is driven for operation on receipt of an operation signal from the center control circuit, the drive shaft 63 rotates so that the mobile block 62 should move in the X-direction along the guide rails 61.

The Y- directional shifter unit 80 includes a guide rail 81 secured on the mobile block 62 of the X-directional shifter block 60 and a horizontal mobile block 82 slidably mounted to the guide rail 81. The guide rail 81 extends in the Y direction. A threaded drive shaft 83 extends on the mobile block 62 in parallel to the guide rail 81 while being rotatably carried by bearings 84. The drive shaft 83 is in screw engagement with a thread piece 85 secured to the bottom face of the mobile block 82. One end of the drive shaft 83 is coupled via a connector 86 to a servo motor 87 arranged on the mobile block 62 of the X-directional shifter unit 60. This servo motor 87 is also connected to the above-described center control circuit. As the servo motor 87 is driven for operation on receipt of an operation signal from the center control circuit, the drive shaft 83 rotates so that the mobile block 82 should move in the Y direction along the guide rail 81.

The clothing controller 90 takes the form of an elongated flat plate fixed at one end to the mobile block 82 of the Y-directional shifter unit 80. The other end of the clothing controller 90 terminates near the rotary disc 3 in the operation table 2. The level of the clothing controller 90 should preferably be adjustable so that the clothing to be sewn should be clamped firm between the top face of the operation table 2 and the bottom face of the clothing controller 90 as best seen in FIG. 2.

Figure 3:
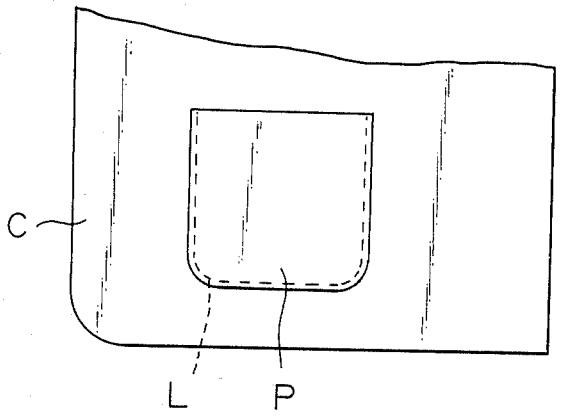
FIG. 3 is a fragmentary perspective view of clothing on which a fabric piece is pick-up sewn along a curved sewing line.

Thus, as the servo motors 67 and 87 are driven for operation on receipt of the operation signals from the center control circuit, the clothing controller 90 and the clothing clamped thereby move on the operation table 2 in X and Y directions as programmed under computer control and, concurrently, operation of the servo motor 29 caused by receipt of the operation signal from the center control circuit makes the needle N rotate in the horizontal direction as programmed under computer control so that the point of the needle should always be directed in tangential directions of the sewing line L on the clothing C (see FIG. 3). Sewing operation of the needle N itself is driven by the needle drive motor 22 on the holder bracket 21.

As shown in FIG. 3, the present invention is most typically applied to pick-up sewing of an outer pocket P to the clothing C. However, by properly changing the programme to be loaded on the computer, the apparatus in accordance with the present invention is usable for pick-up sewing of any fabric pieces to clothing which have curved sewing lines.

In the case of the embodiment shown in FIG. 1, the section of the clothing to be sewn is pressed to the needle N by operation of a pressor rod 43 carried by the holder arm 42. The pressor rod 43 is axially displaceable but blocked against axial rotation. When pick-up sewing is carried out along a curved section of a sewing line, absence of the axial rotation of the pressor rod 43 tends to cause unstable follow of the fabric piece of the clothing to be sewn to the horizontal rotation of the sewing unit 20 generated by the operation of the servo motor 29. Such unstable follow connects to disorder in the sewing line whilst impairing the appearance of the clothing processed. Such unstable follow further increases loads on the servo motors 67 and 87 for the shifter units 60 and 80 and, as a consequence, degrades smoothness in movement of the clothing controller 90.

Figure 4:
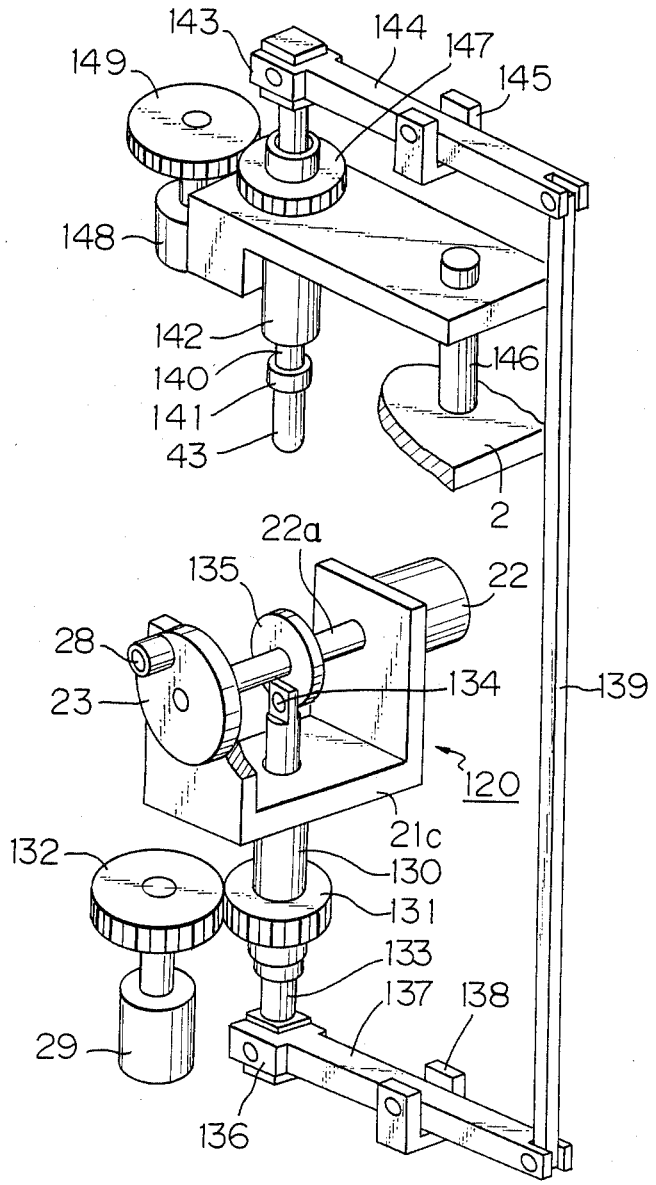
FIG. 4 is a fragmentary perspective view of another embodiment of the automatic apparatus in accordance with the present invention.

These troubles may be avoided if the pressor rod 43 is rotated axially in synchronism with the horizontal rotation of the sewing unit 20. This requirement is satisfied by use of another embodiment of the apparatus in accordance with the present invention shown in FIG. 4, in which elements substantially same in construction and operation as those used for the embodiment shown in FIG. 1 are indicated with same reference numerals.

In the case of this embodiment, the holder bracket 21 of the sewing unit 120 is secured to the top of a hollow rotary shaft 130 and a spar gear 31 is secured to the lower end of the rotary shaft 130 in meshing engagement with a spar gear 132 secured to the output shaft of a servo motor 29. Like the first embodiment, this servo motor 29 is also connected to the central control circuit which issues operation signals under computer control.

A rod 133 of a smaller diameter extends freely through the rotary shaft 130 and freely through the bottom section 21*c* of the holder bracket 21. The top end of the rod 133 is coupled to a pin 134 secured near the periphery of a cam disc 135. The cam disc 135 is secured to the output shaft 22*a* of the needle drive motor 22. The lower end of the rod 133 is coupled via a pivotal joint 136 to one end of a swing lever 137 which is pivoted to a fixed stand 138. The other end of the swing lever 137 is pivoted to the lower end of a connecting link 139.

The pressor rod 43 is coupled via a connector 141 to a rod 140 which extends through a rotary shaft 142. The rod 140 and the rotary shaft 142 are in spline engagement with each other. That is, the rod 140 is axially displaceable in the rotary shaft 142 but follows rotation of the rotary shaft 142. The top end of the rod 140 is coupled via a pivotal joint 143 to one end of a swing lever 144 which is pivoted to a fixed stand 145. The other end of the swing lever 144 is pivoted to the top end of the connecting link 139.

In the case of this embodiment, the holder arm 42 is secured at its one end to an upright post 146 mounted to the operation table 2. The holder arm 42 rotatably carries the rotary shaft 142 which securedly carries a spar gear 147. The holder arm 42 further carries at its another end a servo motor 148 whose output shaft carries a spar gear 149 in meshing engagement with the spar gear 147 on the rotary shaft 142. The servo motor 148 is connected to the center control circuit so that it should operates in synchronism with the operation of the servo motor 29 for the sewing unit 20.

On operation of the needle drive motor 22, the rod 133 moves up and down and this movement is transmitted to the pressor rod 43 via the elements 137, 139, 144 and 140. In this way, the vertical movement of the pressor rod 43 is generated in synchronism with the swing motion of the needle N which, as in the first embodiment, is also caused by the needle drive motor 22. As the servo motor 29 operates to rotate the sewing unit 120 with the needle N, the pressor rod 43 follows this rotation being driven by the servo motor 148 synchronized in operation with the servo motor 29.

Use of this embodiment assures smooth control on movement of the clothing in the operation table 2, thereby avoiding undesirable disorder in the sewing line on the clothing. Further, when compared with the first embodiment, loads on the servo motors 67 and 87 for the shifter units 60 and 80 are greatly reduced and, as a consequence, movement of the clothing controller 90 is significantly smoothed.

I claim:

1. Automatic apparatus for pick-up sewing of curved edges of a fabric piece on clothing comprising a flat horizontal base plate, a flat horizontal operation table coupled to said base plate and provided with a rotary disc having a center opening, a sewing unit secured to the bottom face of said rotary disc, and provided with a sewing needle facing said center opening of said rotary disc, a needle drive motor for driving said sewing needle for said pick-up sewing and a first servo motor for driving said sewing needle for horizontal rotation about the center of said rotary disc, a pressor unit arranged on said operation table, and provided with a pressor rod directed towards said center of said rotary disc and means for causing axial displacement of said pressor rod, an X-directional shifter unit arranged on said base plate and provided with a second servo motor, a Y-directional shifter unit arranged on said X-directional shifter unit and provided with a third servo motor, a clothing controller carried by said Y-directional shifter unit and extending almost horizontally over said operation table in order to clamp said clothing therebetween, and a center control circuit connected to said servo motors for supply of operation signals as programmed under computer control.

2. Automatic apparatus as claimed in claim 1 in which said axial displacement causing means of said pressor unit includes a solenoid vertically arranged on said operation table and operationally coupled to said pressor rod by means of a holder arm.

3. Automatic apparatus as claimed in claim 1 in which said pressor unit further includes means for causing axial rotation of said pressor rod in synchronism with said horizontal rotation of said sewing needle generated by said first servo motor.

4. Automatic apparatus as claimed in claim 3 in which said pressor unit further includes a holder arm horizontally fixed above said operation table, said axial displacement causing means of said pressor unit includes a cam disc secured to the output shaft of said needle drive motor, a first rod coupled at its top end to said cam disc, a second rod carrying said pressor rod and extending upwards freely through said holder arm, and means for linking said first rod to said second rod, and said axial rotation causing means of said pressor unit includes a hollow rotary shaft rotatably carried by said holder arm in spline engagement with said second rod, and a fourth servo motor mounted to said holder arm and causing rotation of said rotary shaft in synchronism with said first drive motor under control by said center control circuit.

5. Automatic apparatus as claimed in claim 1 or 3 in which said X-directional shifter unit includes at least one first guide rail arranged on said base plate and extending in the X direction, a first mobile block slidably mounted to said first guide rail, and a first threaded drive shaft coupled to the output shaft of said second servo motor and extending in parallel to said first guide rail in screw engagement with said first mobile block.

6. Automatic apparatus as claimed in claim 5 in which said Y-directional shifter unit includes at least one second guide rail arranged on said first mobile block and extending in the Y direction, a second mobile block slidably mounted to said second guide rail, and a second threaded drive shaft coupled to the output shaft of said third servo motor and extending in parallel to said second guide rail in screw engagement with said second mobile block.

7. Automatic apparatus as claimed in claim 1 in which said clothing controller is adjustable in level with respect to the top face of said operation table.

* * * * *

UNITED STATES PATENT AND TRADEMARK OFFICE

CERTIFICATE OF CORRECTION

PATENT NO. : 4,577,570

DATED : March 25, 1986

INVENTOR(S) : Masatoshi Ichimura

It is certified that error appears in the above-identified patent and that said Letters Patent is hereby corrected as shown below:

In the Heading

[30] Foreign Application Priority Data

Delete "Aug. 27, 1983" and insert therefor --Sept. 27, 1983--.

Signed and Sealed this

*Sixteenth* Day of *September 1986*

[SEAL]

*Attest:*

DONALD J. QUIGG

*Attesting Officer*

*Commissioner of Patents and Trademarks*